US005212145A

United States Patent [19]

Tsuchida et al.

[11] Patent Number: 5,212,145

[45] Date of Patent: May 18, 1993

[54] HEAT SENSITIVE RECORDING MATERIAL

[75] Inventors: Tetsuo Tsuchida, Takarazuka; Yasuji Koga, Kobe; Haruo Omura, Sakai; Yoshihiro Shimizu, Nishinomiya; Shuji Yoda, Kobe, all of Japan

[73] Assignee: Kanzaki Paper Manufacturing Co., Ltd., Tokyo, Japan

[21] Appl. No.: 917,267

[22] Filed: Jul. 23, 1992

[30] Foreign Application Priority Data

Jul. 25, 1991 [JP] Japan ..... 3-186692
Jul. 31, 1991 [JP] Japan ..... 3-192376
Dec. 24, 1991 [JP] Japan ..... 3-340703

[51] Int. Cl.[5] ..... B41M 5/26

[52] U.S. Cl. ..... 503/207; 503/209; 503/214; 503/216; 503/225

[58] Field of Search ..... 503/207, 209, 214, 216, 503/225; 427/150-152

[56] References Cited

U.S. PATENT DOCUMENTS 3,859,112 1/1975 Kohmura et al. ..... 117/36.8

*Primary Examiner*—Pamela R. Schwartz
*Attorney, Agent, or Firm*—Nikaido, Marmelstein, Murray & Oram

[57] ABSTRACT

A heat sensitive recording material having a recording layer formed on a substrate and containing a colorless or light-colored basic dye and a color acceptor, the heat sensitive recording material being characterized in that at least one ethyleneimine derivative of the following formula (1) is contained in the recording layer as a preservability improving agent for record images (1)

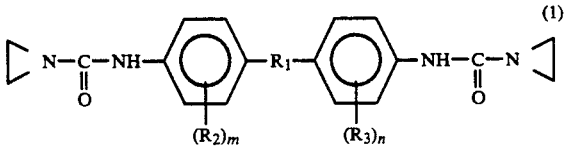

wherein $R_1$ is direct bond, —O—, —S—, —$SO_2$— or $C_1 \sim C_6$ alkylene, $R_2$ and $R_3$ are each $C_1 \sim C_4$ alkyl, $C_1 \sim C_4$ alkoxyl or halogen atom, m and n are each zero or an integer of 1 to 4.

14 Claims, No Drawings

HEAT SENSITIVE RECORDING MATERIAL

The present invention relates to heat sensitive recording materials, more particularly to heat sensitive recording materials which are excellent in preservability of record images, less susceptible to background fogging and excellent in color forming ability.

Heat sensitive recording materials are well known which are adapted to produce record images by thermally contacting a colorless or light-colored basic dye with an organic or inorganic color acceptor for a color forming reaction. With remarkable progress in thermal recording systems, the heat sensitive recording material is used in various fields and in a variety of form. For example, the heat sensitive recording material is increasingly employed in a new use such as a label for POS (Point of Sales) system as well as in record media for a thermal facsimile or thermal printer.

However, the heat sensitive recording material is usually insufficient in preservability of record images and has a defect of the record image becomes faded with a lapse of time. Particularly when exposed at high humidity or high temperature condition, or contacted with plasticizer contained in polyvinyl chloride film, cosmetics, alcohol or like chemical, etc., the record image becomes faded in relatively short period of time, and thus improvement is strongly desired.

To improve preservability of record images, it is proposed to add various preservability improving agents to a heat sensitive recording material, but sufficient effects are not attained or newly arised problems occur with the improvement such as decrease in whiteness. Thus, sufficient results are not necessarily obtained.

An object of the present invention is to provide a heat sensitive recording material having a recording layer containing a colorless or light-colored basic dye and a color acceptor, and which is excellent in preservability of record images, especially in chemical resistance, less susceptible to background fogging and excellent in color forming ability.

The above and other objects of the invention will become apparent from the following description.

The present inventors have widely investigated on the technique of improving preservability of record images of a heat sensitive recording material having a recording layer formed on a substrate and containing a colorless or light-colored basic dye and a color acceptor, and have found that a heat sensitive recording material which is excellent in preservability of record images, especially in chemical resistance, less susceptible to background fogging and excellent in color forming ability is obtained by use of a specific ethyleneimine derivative as a preservability improving agent. The present invention has been accomplished by the above finding.

The present invention provides a heat sensitive recording material having a recording layer formed on a substrate and containing a colorless or light-colored basic dye and a color acceptor, the heat sensitive recording material being characterized in that at least one ethyleneimine derivative of the following formula (1) is contained in the recording layer as a preservability improving agent for record images

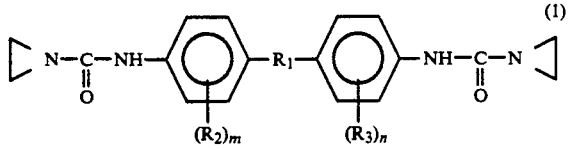

(1)

wherein $R_1$ is direct bond, —O—, —S—, —$SO_2$— or $C_1 \sim C_6$ alkylene, $R_2$ and $R_3$ are each $C_1 \sim C_4$ alkyl, $C_1 \sim C_4$ alkoxyl or halogen atom, m and n are each zero or an integer of 1 to 4.

In the present invention, examples of ethyleneimine derivatives of the formula (1) are as follows.

4,4'-Bis(ethyleneiminocarbonylamino)biphenyl, 4,4'-bis(ethyleneiminocarbonylamino)-3,3'-dimethylbiphenyl, 4,4'-bis(ethyleneiminocarbonylamino)-3,3'-di-tert-butylbiphenyl, 4,4'-bis(ethyleneiminocarbonylamino)-3,3'-dimethoxybiphenyl, 4,4'-bis(ethyleneiminocarbonylamino)-3,3'-dichlorobiphenyl, bis(4-ethyleneiminocarbonylaminophenyl)ether, bis(4-ethyleneiminocarbonylaminophenyl)sulfide, bis(4-ethyleneiminocarbonylaminophenyl)sulfone, bis(4-ethyleneiminocarbonylamino-3,5-dibromophenyl)sulfone, bis(4-ethyleneiminocarbonylamino-3,5-dichlorophenyl)sulfone, bis(4-ethyleneiminocarbonylamino-3,5-di-tert-butylphenyl)sulfone, bis(4-ethyleneiminocarbonylaminophenyl)methane, bis(4-ethyleneiminocarbonylamino-3-methylphenyl)methane, bis(4-ethyleneiminocarbonylamino-3-methoxyphenyl)methane, bis(4-ethyleneiminocarbonylamino-3,5-dimethoxyphenyl)methane, 1,2-bis(4-ethyleneiminocarbonylaminophenyl)ethane, 1,1-bis(4-ethyleneiminocarbonylaminophenyl)ethane, 2,2-bis(4-ethyleneiminocarbonylaminophenyl)propane, 2,2-bis(4-ethyleneiminocarbonylaminophenyl)butane, 2,2-bis(4-ethyleneiminocarbonylaminophenyl)-4-methylpentane, etc. These ethyleneimine derivatives are not limited to thereabove and can be used, as required, in a mixture of at least two of them.

Among these ethyleneimine derivatives especially preferable is bis(4-ethyleneiminocarbonylaminophenyl)methane which is particularly excellent in improving preservability of record images.

The amount of the ethyleneimine derivative is not particularly limited and is usually 5 to 500 parts by weight, preferably 10 to 200 parts by weight per 100 parts by weight of the basic dye.

In the present invention, various known dyes are used as the colorless or light-colored basic dye which is contained in the recording layer of the heat sensitive recording material. Preferably used is a dye having a lactone ring in the molecule which exhibits particularly excellent effect. Examples thereof are:

Triarylmethane-based dyes, e.g., 3,3-bis(p-dimethylaminophenyl)-6-dimethylaminophthalide, 3,3-bis(p-dimethylaminophenyl)phthalide, 3-(4-dimethylaminophenyl)-3-(4-diethylamino-2-methylphenyl)-6-(dimethylamino)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Divinylphthalide-based dyes, e.g., 3,3-bis[1,1-bis-(4-pyrrolidinophenyl)ethylene-2-yl]-4,5,6,7-tetrabromophthalide, 3,3-bis[1-(4-methoxyphenyl)-1-(4-dimethylaminophenyl)ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-dimethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-diethylaminofluoran, 4-benzylamino-8-diethylamino-benzo[a]fluoran, 3-[4-(4-dimethylaminoanilino)anilino]-7-chloro-6-methylfluoran, 3-[4-(4-phenylanilino)anilino]-7-chloro-6-methylfluoran, 8-[-4-(4-dimethylaminoanilino)anilino]-benzo[a]fluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-di-n-butylamino-6-methyl-7-phenylaminofluoran, 3-di-n-pentylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-di-n-butylamino-7-(o-chlorophenylamino)fluoran, 3-(N-ethyl-N-tetrahydrofurfurylamino)-6-methyl-7-phenylaminofluoran, 3-(N-methyl-N-n-propylamino)-6-methyl-7-phenylaminofluoran, 3-pyrrolidino-6-methyl-7-p-butylphenylaminofluoran, 3-(N-methyl-N-n-propylamino)-6-methyl-7-phenylaminofluoran, 3-(N-ethyl-N-isobutylamino)-6-methyl-7-phenylaminofluoran, 3-(N-methyl-N-n-hexylamino)-6-methyl-7-phenylaminofluoran, 3-(N-ethyl-N-n-hexylamino)-6-methyl-7-phenylaminofluoran, 3-(N-ethyl-N-cyclopentylamino)-6-methyl-7-phenylaminofluoran, 3-[N-(3-ethoxypropyl)-N-methylamino]-6-methyl-7-phenylaminofluoran, 3-[N-ethyl-N-(3-ethoxypropyl)amino]-6-methyl-7-phenylaminofluoran, 3-diethylamino-7-[m-(trifluoromethyl)phenylamino]-fluoran, 3-diethylamino-7-(o-fluorophenylamino)fluoran, 3-di-n-butylamino-7-(o-fluorophenylamino)fluoran, 3-diethylamino-6-chloro-7-phenylaminofluoran, 3-(N-ethyl-N-isoamylamino)-7-(o-chlorophenylamino)fluoran, 3-(N-ethyl-N-n-hexylamino)-7-(o-chlorophenylamino)fluoran, etc.

Fluorene-based dyes, e.g., 3,6-bis(dimethylamino)-fluorene-9-spiro-3'-(6'-dimethylamino)phthalide, 3-diethylamino-6-(N-allyl-N-methylamino)fluorene-9-spiro-3'-(6'-dimethylamino)phthalide, 3,6-bis(dimethylamino)-spiro[fluorene-9,6'-6'H-chromeno(4,3-b)indole], 3,6-bis(dimethylamino)-3'-methyl-spiro[fluorene-9,6'-6'H-chromeno(4,3-b)indole], 3,6-bis(diethylamino)-3'-methyl-spiro[fluorene-9,6'-6'H-chromeno(4,3-b)indole], etc. These basic dyes are not limited to thereabove and can be used, as required, in a mixture of at least two of them.

In the present invention, various known compounds are used as a color acceptor. Examples thereof are 4-tert-butylphenol, α-naphthol, β-naphthol, 4-acetylphenol, 4-tert-octylphenol, 4,4'-sec-butylidenediphenol, 4-phenylphenol, 4,4'-dihydroxy-diphenylmethane, 4,4'-isopropylidenediphenol, hydroquinone, 4,4'-cyclohexylidenediphenol, 4,4'-(1,3-dimethylbutylidene)bisphenol, 2,2-bis(4-hydroxyphenyl)-4-methylpentane, 4,4'-dihydroxydiphenylsulfide, 4,4'-thiobis(6-tert-butyl-3-methylphenol), 1,3-di[2-(4-hydroxyphenyl)-2-propyl]-benzene, hydroquinone monobenzyl ether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, butyl bis(4-hydroxyphenyl)acetate, 2-phenoxyethyl bis(4-hydroxyphenyl)acetate, p-hydroxy-N-(2-phenoxyethyl)benzenesulfonamide, 1,5-bis(4-hydroxyphenylthio)-3-oxa-pentane, 1,7-bis(4-hydroxyphenylthio)-3,5-dioxa-heptane, 1,8-bis(4-hydroxyphenylthio)-3,6-dioxa-octane, 2-(4-hydroxyphenylthio)ethyl (4-hydroxyphenylthio)acetate, novolak phenol resin, phenolic polymer and like phenolic compounds; benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3,5-di-tert-butylsalicylic acid, 3-benzylsalicylic acid, 3-(α-methylbenzyl)salicylic acid, 3-chloro-5-(α-methylbenzyl)-salicylic acid, 3-phenyl-5-(α,α-dimethylbenzyl)salicylic acid, 3,5-di-α-methylbenzylsalicylic acid, 4-(2-p-methoxyphenoxyethoxy)salicylic acid, 4-(3-p-tolylsulfonylpropyloxy)salicylic acid, 5-[p-(2-p-methoxyphenoxyethoxy)-cumyl]salicylic acid and like aromatic carboxylic acids; also, salts of such phenolic compounds or aromatic carboxylic acids with zinc, magnesium, aluminum, calcium, titanium, manganese, tin, nickel and like polyvalent metals; complex of antipyrine and zinc thiocyanate and like metal complexes; diphenylsulfone derivative of the following formula (2),

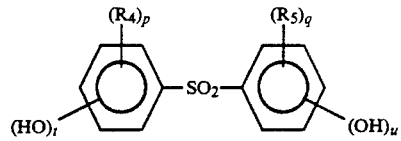

(2)

wherein $R_4$ and $R_5$ are each $C_1 \sim C_4$ alkyl, $C_2 \sim C_4$ alkenyl, $C_1 \sim C_4$ alkoxyl, benzyloxy or halogen atom, t is zero or an integer of 1 to 2, u is an integer of 1 to 3, p and q are each zero or an integer of 1 to 4. The above color acceptor can be used, as required, in a mixture of at least two of them.

Among the above color acceptors preferably used is the diphenylsulfone derivative of the formula (2) which affords a heat sensitive recording material which is excellent in preservability of record images, especially in chemical resistance.

Examples of the diphenylsulfone derivative of the formula (2) are as follows.

4,4'-Dihydroxydiphenylsulfone, 2,4'-dihydroxydiphenylsulfone, 3,3'-diallyl-4,4'-dihydroxydiphenylsulfone, 3,3',5,5'-tetrabromo-4,4'-dihydroxydiphenylsulfone, 3,3',5,5'-tetrachloro-4,4'-dihydroxydiphenylsulfone, 4-hydroxydiphenylsulfone, 4-hydroxy-4'-methyldiphenylsulfone, 4-hydroxy-3',4'-trimethylenediphenylsulfone, 4-hydroxy-3',4'-tetramethylenediphenylsulfone, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-n-butoxydiphenylsulfone, 4-hydroxy-4'-benzyloxydiphenylsulfone, 3,4-dihydroxydiphenylsulfone, 3,4-dihydroxy-4'-methyldiphenylsulfone, 3,4,4'-trihydroxydiphenylsulfone, 3,4,3',4'-tetrahydroxydiphenylsulfone, 2,3,4-trihydroxydiphenylsulfone, etc.

Among the diphenylsulfone derivative more preferably used are 2,4'-dihydroxydiphenylsulfone and 4-hydroxy-4'-isopropoxydiphenylsulfone which are excellent in improving preservability of record images and less susceptible to background fogging.

With the heat sensitive recording materials of the invention, the proportions of basic dye and color acceptor are not particularly limited. For example, usually 100 to 700 parts by weight, preferably 150 to 400 parts by weight, of the color acceptor is used per 100 parts by weight of the basic dye.

In the present heat sensitive recording material, it is possible to add a recording sensitivity improving agent (sensitizer) to a recording layer in order to obtain an excellent amenability to high-speed recording. Examples of useful sensitizers are caproic acid amide, capric acid amide, palmitic acid amide, stearic acid amide, oleic acid amide, erucic acid amide, linoleic acid amide, linolenic acid amide, N-methylstearic acid amide, stearic acid anilide, N-methyloleic acid amide, benzanilide, linoleic acid anilide, N-ethylcapric acid amide, N-butyllauric acid amide, N-octadecylacetamide, N-oleylacetamide, N-oleylbenzamide, N-stearylcyclohexylamide, polyethylene glycol, 1-benzyloxynaphthalene, 2-benzyloxynaphthalene, 1-hydroxynaphthoic acid phenyl ester, 1,2-diphenoxyethane, 1,4-diphenoxybutane, 1,2-bis(3-methylphenoxy)ethane, 1,2-bis(4-methoxyphenoxy)ethane, 1-phenoxy-2-(4-chlorophenoxy)ethane, 1-phenoxy-2-(4-methoxyphenoxy)ethane, 1-(2-methylphenoxy)-2-(4-methoxyphenoxy)ethane, dibenzyl terephthalate, dibenzyl oxalate, di(4-methylbenzyl) oxalate, benzyl p-benzyloxybenzoate, p-benzylbiphenyl, 1,5-bis(p-methoxyphenoxy)-3-oxapentane, 1,4-bis(2-vinyloxyethoxy)bebzene, p-biphenyl p-tolyl ether, benzyl p-methylthiophenyl ether, 2-(2'-hydroxy-5'-methylphenyl)benzotriazole and 2-hydroxy-4-benzyloxybenzophenone, etc.

It is desired that the amount of sensitizer to be used be adjusted generally within the range of usually 50 to 1000 parts by weight, preferably 100 to 500 parts by weight per 100 parts by weight of the basic dye although not limited specifically.

For preparing a coating composition comprising the foregoing components, the basic dye, color acceptor and the ethyleneimine derivative and the like are dispersed, together or individually, into water serving as a dispersion medium, using stirring and pulverizing means such as a ball mill, attritor, vertical or horizontal sand mill or the like.

Usually the coating composition has incorporated therein a binder in an amount of 2 to 40% by weight, preferably 5 to 25% by weight, based on the total solids content of the composition. Examples of useful binders are starches, hydroxyethyl cellulose, methyl cellulose, carboxyethyl cellulose, gelatin, casein, gum arabic, polyvinyl alcohol, styrene-maleic anhydride copolymer salt, styrene-acrylic acid copolymer salt, isobutylene-styrene-maleic anhydride terpolymer salt, styrene-butadiene copolymer emulsion, etc.

Among these binders, use of isobutylene-styrene-maleic anhydride terpolymer salt is one of preferable embodiments since the above terpolymer salt affords a heat sensitive recording material which is less susceptible to background fogging, especially when the recording material is preserved at a high humidity condition.

Preferable terpolymer is one in which a monomer molar ratio of isobutylene:styrene:maleic anhydride is $0.1\sim0.5:0.1\sim0.5:0.1\sim0.5$ and an average molecular weight is about 1000 to 200,000. Preferable salt is sodium, potassium or ammonium salt.

In the present invention, when the above terpolymer salt is used to improve background fogging, the salt is used in an amount of 5 to 500 parts by weight, preferably 10 to 200 parts by weight per 100 parts by weight of the basic dye. When the salt is used with other binder, the salt is preferably used in an amount of at least 10% by weight based on a total weight of binders.

Various other auxiliary agents can be further added to the coating composition. Examples of useful agents are dispersants such as sodium dioctylsulfosuccinate, sodium dodecylbenzenesulfonate, sodium salt of lauryl alcohol-sulfuric acid ester, fatty acid metal salts, etc., defoaming agents, fluorescent dyes, coloring dyes, etc.

In addition, to the composition may be added in order to prevent the adhesion of tailings to the thermal head, inorganic pigment such as kaolin, clay, talc, calcium carbonate, magnesium carbonate, barium carbonate, zinc carbonate, calcined clay, titanium oxide, kieselguhr, finely divided anhydrous silica, activated clay, etc. Further, to the composition may be added, in order to prevent sticking upon contact of the heat sensitive recording material with a thermal head, a dispersion or emulsion of stearic acid, polyethylene, carnauba wax, paraffin wax, zinc stearate, calcium stearate, ester wax or the like.

Among the inorganic pigments, the use of calcium carbonate, magnesium carbonate, barium carbonate, zinc carbonate and like carbonate is one of preferable embodiments since the carbonate provides a heat sensitive recording material which is greatly improved in background fogging especially at a high humidity condition. Among the carbonates more preferably used is magnesium carbonate having an average primary particle size of about 0.1 to 3 μm which exhibits particularly excellent effect.

When the above carbonate is used to improve background fogging, the carbonate is used in an amount of 5 to 500 parts by weight, preferably 10 to 200 parts by weight per 100 parts by weight of the basic dye. The carbonate can be used with other pigment and is used in an amount of at least 50% by weight based on a total weight of pigments.

Further, it is possible to use a hindered amine in order to prevent decrease in whiteness during preservation of a long period of time. Examples of useful hindered amines are as follows.

4-Benzoyloxy-2,2,6,6-tetramethylpiperidine, 4-benzoyloxy-1,2,2,6,6-pentamethylpiperidine, bis(2,2,6,6-tetramethyl-4-piperidyl)-1,2-ethanedicarboxylate, bis(1,2,2,6,6-pentamethyl-4-piperidyl)-1,2-ethanedicarboxylate, bis(2,2,6,6-tetramethyl-4-piperidyl)-1,8-octanedicarboxylate, bis(1,2,2,6,6-pentamethyl-4-piperidyl)-1,8-octanedicarboxylate, bis(1,2,2,6,6-pentamethyl-4-piperidyl)-1,4-butanedicarboxylate, bis(1,2,2,6,6-pentamethyl-4-piperidyl)-1,6-hexanedicarboxylate, tris(2,2,6,6-tetramethyl-4-piperidyl)-1,1,3-butanetricarboxylate, tris(1,2,2,6,6-pentamethyl-4-piperidyl)-1,1,3-butanetricarboxylate, tetrakis(2,2,6,6-tetramethyl-4-piperidyl)-1,2,3,4-butanetetracarboxylate, tetrakis(1,2,2,6,6-pentamethyl-4-piperidyl)-1,2,3,4-butanetetracarboxylate, tris(2,2,6,6-tetramethyl-4-piperidyl)-tridecyl-1,2,3,4-butanetetracarboxylate, tris(1,2,2,6,6-pentamethyl-4-piperidyl)-tridecyl-1,2,3,4-butanetetracarboxylate, bis(2,2,6,6-tetramethyl-4-piperidyl)-1-butyl-1-(4-hydroxy-3,5-di-tert-butylbenzyl)-1,1-dicarboxylate, bis(1,2,2,6,6-pentamethyl-4-piperidyl)-1-butyl-1-(4-hydroxy-3,5-di-tert-butylbenzyl)-1,1-dicarboxylate, 2,2,6,6-tetramethyl-4-piperidinol, N,N-bis(2,2,6,6-tetramethyl-4-piperidyl)-1,6-diaminohexane/2,4,6-trichlorotriazine/tert-octylamine condensate, tetrakis(1-methyl-4-piperidyl)-1,2,3,4-butanetetracarboxylate, {2,2,6,6-tetramethyl-4-piperidyl/$\beta,\beta,\beta',\beta'$-tetramethyl-3,9-[2,4,8,10-tetraoxaspiro(5,5)undecane]diethyl}-1,2,3,4-butanetetracarboxylate, {1,2,2,6,6-pentamethyl-4-piperidyl/$\beta,\beta,\beta',\beta'$-tetramethyl-3,9-[2,4,8,10-tetraoxaspiro(5,5)undecane]diethyl}-1,2,3,4-butanetetracarboxylate, etc. These hindered amines are not limited to thereabove and can be used, as required, in a mixture of at least two of them.

The amount of the hindered amine is not particularly limited and is usually 5 to 500 parts by weight, preferably 10 to 200 parts by weight per 100 parts by weight of the above ethyleneimine derivative.

In the present heat sensitive recording material, the method of forming the recording layer is not particularly limited. For example, the coating composition is applied to a substrate by an air knife coater, blade coater, bar coater, gravure coater, curtain coater or like suitable means.

The amount of coating composition, which is not limited particularly, is usually 1 to 12 g/m$^2$, preferably 2 to 10 g/m$^2$, based on dry weight. As the substrate is used paper, synthetic fiber paper, synthetic resin film or the like as suitably selected.

Various other known techniques in the field of heat sensitive recording material can be applied. For example, it is possible to form a protective layer on the heat sensitive recording layer to protect a recording layer, to form an intermediate layer between the support and the recording layer, to form a protective layer on the rear surface of the support, to form an adhesive layer on the rear surface of the recording material.

The invention will be described below in more detail with reference to Examples by no means limited to, in which parts and percentages are all by weight, unless otherwise specified.

EXAMPLE 1

① Composition (A)

| | |
|---|---|
| 3-Di-n-butylamino-6-methyl-7-phenylaminofluoran | 10 parts |
| 1,2-Bis(3-methylphenoxy)ethane | 25 parts |
| 5% Aqueous solution of methyl cellulose | 5 parts |
| Water | 50 parts |

These components were pulverized by a horizontal sand mill to prepare Composition (A) having an average particle size of 1.0 μm.

② Composition (B)

| | |
|---|---|
| 4,4'-Isopropylidinediphenol | 20 parts |
| 5% Aqueous solution of methyl cellulose | 5 parts |
| Water | 55 parts |

These components were pulverized by a horizontal sand mill to prepare Composition (B) having an average particle size of 1.5 μm.

③ Composition (C)

| | |
|---|---|
| Bis(4-ethyleneiminocarbonylaminophenyl)methane | 10 parts |
| 5% Aqueous solution of methyl cellulose | 5 parts |
| Water | 35 parts |

These components were pulverized by a horizontal sand mill to prepare Composition (C) having an average particle size of 1.5 μm.

④ Formation of a recording layer

A coating composition was prepared by mixing with stirring 90 parts of Composition (A), 80 parts of Composition (B), 20 parts of Composition (C), 7 parts of finely divided anhydrous silica (oil absorption: 180 ml/100 g), 8 parts of precipitated calcium carbonate (oil absorption: 90 ml/100 g), 50 parts of 20% aqueous solution of polyvinyl alcohol, 15 parts of 30% aqueous dispersion of zinc stearate and 10 parts of water. To a paper substrate weighing 45 g/m$^2$ was applied and dried the above coating composition in an amount of 3 g/m$^2$ by dry weight to obtain a heat sensitive recording paper.

EXAMPLES 2 TO 5

Four kinds of heat sensitive recording papers were prepared in the same manner as in Example 1 except that the following compounds were used in place of bis(4-ethyleneiminocarbonylaminophenyl)methane in the preparation of Composition (C) in Example 1.

Example 2: 4,4'-bis(ethyleneiminocarbonylamino)-3,3'-dimethylbiphenyl

Example 3: 4,4'-bis(ethyleneiminocarbonylamino)-3,3'-dimethoxybiphenyl

Example 4: 2,2'-bis(ethyleneiminocarbonylaminophenyl)propane

Example 5: bis(4-ethyleneiminocarbonylamino-3-methylphenyl)methane

EXAMPLES 6 TO 10

Five kinds of heat sensitive recording papers were prepared in the same manner as in Example 1 except that the following compounds were used in place of 4,4'-isopropylidenediphenol in the preparation of Composition (B) in Example 1.

Example 6: 2,2-bis(4-hydroxyphenyl)-4-methylpentane

Example 7: butyl bis(4-hydroxyphenyl)acetate

Example 8: 2,4'-dihydroxydiphenylsulfone

Example 9: 4-hydroxy-4'-isopropoxydiphenylsulfone

Example 10: 3,3'-diallyl-4,4'-dihydroxydiphenylsulfone

EXAMPLE 11

A heat sensitive recording paper was prepared in the same manner as in Example 1 except that 8 parts of magnesium carbonate (average primary particle size: 0.2 μm) was used in place of 8 parts of precipitated calcium carbonate in the formation of the heat sensitive recording layer.

EXAMPLE 12

A heat sensitive recording paper was prepared in the same manner as in Example 1 except that 25 parts of 20% aqueous solution of sodium salt of isobutylene-styrene-maleic anhydride terpolymer (molar ratio: 0.39/0.22/0.39, average molecular weight: 80000) and 25 parts of 20% aqueous solution of polyvinyl alcohol were used in place of 50 parts of 20% aqueous solution of polyvinyl alcohol in the formation of the heat sensitive recording layer.

EXAMPLE 13

① Compositions (A), (B) and (C) were prepared in the same manner as in Example 1.

② Composition (D)

| | |
|---|---|
| Tetrakis(1,2,2,6,6-pentamethyl-4-piperidyl)-1,2,3,4-butanetetracarboxylate | 10 parts |
| 5% Aqueous solution of methyl cellulose | 5 parts |
| Water | 35 parts |

These components were pulverized by a horizontal sand mill to prepare Composition (D) having an average particle size of 1.5 μm.

③ Formation of a recording layer

A coating composition was prepared by mixing with stirring 90 parts of Composition (A), 80 parts of Composition (B), 20 parts of Composition (C), 20 parts of Composition (D), 7 parts of finely divided anhydrous silica (oil absorption: 180 ml/100 g), 8 parts of precipitated calcium carbonate (oil absorption: 90 ml/100 g), 50 parts of 20% aqueous solution of polyvinyl alcohol, 15 parts of 30% aqueous dispersion of zinc stearate and 10 parts of water. To a paper substrate weighing 45 g/m$^2$ was applied and dried the above coating composition in an amount of 3 g/m$^2$ by dry weight to obtain a heat sensitive recording paper.

COMPARISON EXAMPLE 1

A heat sensitive recording paper was prepared in the same manner as in Example 1 except that Composition (C) was not used in the formation of the heat sensitive recording layer.

COMPARISON EXAMPLE 2

A heat sensitive recording paper was prepared in the same manner as in Example 1 except that 4,4'-thiobis(3-methyl-6-tert-butylphenol) was used in place of bis(4-ethyleneiminocarbonylaminophenyl)methane in the preparation of Composition (C) in Example 1.

COMPARISON EXAMPLE 3

A heat sensitive recording paper was prepared in the same manner as in Example 1 except that 40 parts of 10% aqueous solution of 1,6-bis(ethyleneiminocarbonylamino)hexane was used in place of 20 parts of Composition (C) in Example 1.

The 16 kinds of heat sensitive recording papers thus prepared were fed to a thermal facsimile system (Model HIFAX-400, product of Hitachi Ltd.) for recording and checked for color density of the recorded images and blank (background) areas by a Macbeth densitometer (Model RD-100R, with an amber filter, product of Macbeth Corp.). Table 1 shows the results.

The heat sensitive recording papers used for recording were allowed to stand under the conditions of 40° C. and 70% RH for 24 hours (weather resistance), or allowed to stand at room temperature for 24 hours with polyvinyl chloride film containing plasticizer superposed on the image bearing surface (plasticizer resistance), and thereafter checked for color density of the recorded images and blank areas by a Macbeth densitometer. The results are given in Table 1.

TABLE 1

| | color density in recorded image (A) and blank area (B) | | | | | |
|---|---|---|---|---|---|---|
| | no treatment | | weather resistance | | plasticizer resistance | |
| | (A) | (B) | (A) | (B) | (A) | (B) |
| Ex. 1 | 1.35 | 0.07 | 1.23 | 0.11 | 1.08 | 0.09 |
| Ex. 2 | 1.32 | 0.07 | 1.16 | 0.09 | 0.85 | 0.11 |
| Ex. 3 | 1.34 | 0.06 | 1.15 | 0.09 | 0.89 | 0.10 |
| Ex. 4 | 1.33 | 0.07 | 1.16 | 0.10 | 0.84 | 0.11 |
| Ex. 5 | 1.35 | 0.07 | 1.15 | 0.09 | 0.82 | 0.10 |
| Ex. 6 | 1.34 | 0.06 | 1.17 | 0.08 | 1.02 | 0.08 |
| Ex. 7 | 1.33 | 0.06 | 1.18 | 0.08 | 1.05 | 0.07 |
| Ex. 8 | 1.35 | 0.05 | 1.27 | 0.06 | 1.21 | 0.05 |
| Ex. 9 | 1.36 | 0.05 | 1.25 | 0.07 | 1.17 | 0.06 |
| Ex. 10 | 1.35 | 0.06 | 1.26 | 0.09 | 1.20 | 0.09 |
| Ex. 11 | 1.34 | 0.06 | 1.22 | 0.09 | 1.09 | 0.07 |
| Ex. 12 | 1.35 | 0.06 | 1.23 | 0.08 | 1.06 | 0.07 |
| Ex. 13 | 1.34 | 0.06 | 1.22 | 0.09 | 1.07 | 0.07 |
| Com. Ex. 1 | 1.29 | 0.06 | 1.03 | 0.10 | 0.06 | 0.06 |
| Com. Ex. 2 | 1.29 | 0.07 | 1.05 | 0.15 | 0.07 | 0.07 |
| Com. Ex. 3 | 1.27 | 0.10 | 1.01 | 0.23 | 0.35 | 0.12 |

The results given in Table 1 reveal that the heat sensitive recording materials of the present invention are excellent in preservability of record images, especially in chemical resistance, less susceptible to background fogging and excellent in color forming ability.

We claim:

1. A heat sensitive recording material having a recording layer formed on a substrate and containing a colorless or light-colored basic dye and a color acceptor, the heat sensitive recording material being characterized in that at least one ethyleneimine derivative of the following formula (1) is contained in the recording layer as a preservability improving agent for record images

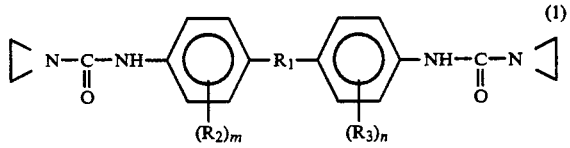

(1)

wherein $R_1$ is direct bond, —O—, —S—, —$SO_2$— or $C_1 \sim C_6$ alkylene, $R_2$ and $R_3$ are each $C_1 \sim C_4$ alkyl, $C_1 \sim C_4$ alkoxyl or halogen atom, m and n are each zero or an integer of 1 to 4.

2. A heat sensitive recording material as defined in claim 1 wherein the ethyleneimine derivative is bis(4-ethyleneiminocarbonylaminophenyl)methane.

3. A heat sensitive recording material as defined in claim 1 wherein the ethyleneimine derivative is used in an amount of 5 to 500 parts by weight per 100 parts by weight of the basic dye.

4. A heat sensitive recording material as defined in claim 1 wherein the basic dye has a lactone ring in the molecule.

5. A heat sensitive recording material as defined in claim 1 wherein the color acceptor is a compound of the formula (2)

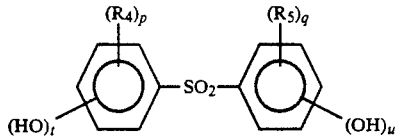

(2)

wherein $R_4$ and $R_5$ are each $C_1 \sim C_4$ alkyl, $C_2 \sim C_4$ alkenyl, $C_1 \sim C_4$ alkoxyl, benzyloxy or halogen atom, t is zero or an integer of 1 to 2, u is an integer of 1 to 3, p and q are each zero or an integer of 1 to 4.

6. A heat sensitive recording material as defined in claim 5 wherein the compound of the formula (2) is 2,4'-dihydroxydiphenylsulfone or 4-hydroxy-4'-isopropoxydiphenylsulfone.

7. A heat sensitive recording material as defined in claim 1 wherein the color acceptor is used in an amount of 100 to 700 parts by weight per 100 parts by weight of the basic dye.

8. A heat sensitive recording material as defined in claim 1 wherein the recording layer further contains a carbonate.

9. A heat sensitive recording material as defined in claim 8 wherein the carbonate is calcium carbonate, magnesium carbonate, barium carbonate or zinc carbonate.

10. A heat sensitive recording material as defined in claim 9 wherein the carbonate is magnesium carbonate having an average primary particle size of about 0.1 to 3 μm.

11. A heat sensitive recording material as defined in claim 8 wherein the carbonate is used in an amount of 5 to 500 parts by weight per 100 parts by weight of the basic dye.

12. A heat sensitive recording material as defined in claim 1 wherein the recording layer further contains an isobutylene-styrene-maleic anhydride terpolymer salt as a binder.

13. A heat sensitive recording material as defined in claim 12 wherein the terpolymer has a monomer molar ratio of isobutylene:styrene:maleic anhydride of $0.1 \sim 0.5:0.1 \sim 0.5:0.1 \sim 0.5$ and has an average molecular weight of about 1000 to 200000.

14. A heat sensitive recording material as defined in claim 1 wherein the recording layer further contains a hindered amine.

* * * * *